US006224368B1

(12) United States Patent
Chung

(10) Patent No.: US 6,224,368 B1
(45) Date of Patent: May 1, 2001

(54) SAFETY LIGHTER WITH COMPOUND FINGER PAD

(76) Inventor: Aman K. M. Chung, Unit 1, 11/F, Wah Lai Ind. Center, 10-14 Kwei Tei St. Fo Tan, Shatin, Hong Kong (CN)

( * ) Notice: Subject to any disclaimer, the term of this patent is extended or adjusted under 35 U.S.C. 154(b) by 0 days.

(21) Appl. No.: 09/477,336

(22) Filed: Jan. 4, 2000

(51) Int. Cl.[7] ..... F23D 11/36; F23Q 2/16
(52) U.S. Cl. ..... 431/153; 431/277
(58) Field of Search ..... 431/277, 153, 431/255, 254

(56) References Cited

U.S. PATENT DOCUMENTS 5,145,358 * 9/1992 Shike et al. ..... 431/277
5,997,282 * 12/1999 Man ..... 431/153
6,022,211 * 2/2000 Wang ..... 431/153

FOREIGN PATENT DOCUMENTS

8902796 * 4/1989 (ES) ..... F23Q/2/34
WO 99/46539 * 9/1999 (WO) ..... F23D/11/36

* cited by examiner

*Primary Examiner*—Carl D. Price
(74) *Attorney, Agent, or Firm*—Nixon & Vanderhye

(57) ABSTRACT

The child safety lighter includes a pair of pivoted elements one of which engages a valve stem for moving a valve between closed and opened positions upon pivoting the element by application of thumb pressure to a first finger-engageable surface. The second element includes a second finger-engageable surface extending about the outer periphery of the first surface whereby the two surfaces combined correspond in shape essentially to a typical thumb press pad of a conventional lighter. The second element is independently pivotal against the bias of a spring. Because the first surface area is reduced and located between the second surface and the spark wheel of the lighter, increased force and dexterity is necessary to pivot the first lever to actuate the lighter.

33 Claims, 5 Drawing Sheets

SAFETY LIGHTER WITH COMPOUND FINGER PAD

TECHNICAL FIELD

The present invention relates to child safety lighters of the type rendering the actuation of the lighter difficult, if not impossible, by a child, and particularly relates to a safety lighter having a compound finger pad for increasing the difficulty of lighter actuation by a child.

BACKGROUND

There is current emphasis in providing safety features for lighters, particularly to prevent actuation of the lighters by children. Many such child safety lighters have focused on preventing depression of the thumb pad of the valve actuator lever. In most conventional lighters, the thumb pad is mounted on one end of a pivotal lever having its opposite end in engagement with a valve for displacing the valve between valve-open and valve-closed positions. In the valve-open position, of course, fuel from the lighter's fuel reservoir is supplied to an ignition region where a spark ignites the fuel and, hence, the lighter. On those conventional child safety lighters, locking mechanisms are typically provided to prevent depression of the lever by thumb pressure on the thumb pad unless and until a safety latch is displaced. In those lighters, once the safety latch is moved to the unlocked position, the lighter is enabled for actuation by thumb pressure on the thumb pad. Actuation of the lighter by a child is thus much more difficult because of the necessity to manipulate the safety latch into its unlocked position prior to depressing the thumb pad. This complicates lighter actuation, presumably beyond the child's capability.

Other types of child safety lighters have incorporated slip wheels astride the spark wheel, preventing rotation of the spark wheel and the generation of a spark absent sufficient pressure on the slip wheels and spark wheel. Typically, the slip wheel serves as a mechanical barrier, preventing a child's thumb access to the spark wheel, with the slip wheels freely rotating relative to the spark wheel, effectively preventing generation of a spark by rotation of the spark wheel. This type of child safety lighter is particularly effective should the child rub the slip wheel along a surface which results only in free-wheeling rotation of the slip wheels and not rotation of the spark wheel.

DISCLOSURE OF THE INVENTION

In accordance with the present invention, a different approach to child safety lighters is taken. In a preferred embodiment of the present invention, a compound finger pad having discrete first and second finger-engageable surfaces forming respective parts of two relatively movable elements is provided. The first finger-engageable surface comprises one end of a first element preferably in the form of a lever pivotally mounted between support arms upstanding from the lighter housing. The first element terminates at its opposite end in a catch engaging a fuel valve. By pivoting this first element by application of thumb pressure on the first finger pad surface thereof, the element displaces the valve from its closed position to an open position, enabling fuel to enter the ignition region. The second finger-engageable surface comprises one end of a lever, the opposite end of which is pivoted relative to the first element. In the non-actuated condition of the lighter, the first and second finger-engageable surfaces preferably form a continuation of one another simulating a continuous single thumb pad. However, alternate arrangements of the first and second finger-engageable surfaces may locate the second surface higher or lower relative to the first surface thereby forming a discontinuous compound finger or thumb pad. Thus, in the preferred embodiment, the combined first and second finger-engageable surfaces of these two elements appears very similar to or identical to the traditional thumb pad for the valve actuating lever of a conventional lighter while the alternate arrangements are very nearly similar to the conventional thumb pad. It will also be appreciated that the first finger-engageable surface is considerably smaller than the traditional area of the thumb pad of a conventional lighter.

The first finger-engageable surface is also located between the second finger-engageable surface and the spark wheel. That is, the first finger-engageable surface for actuating the lighter is surrounded or bounded, by the second finger-engageable surface on all sides, except between the first finger-engageable surface and the spark wheel. The first finger-engageable surface therefore provides a reduced area for application of thumb pressure in comparison with the surface area of the traditional thumb pad. Also, the second finger-engageable surface, when engaged by a child's thumb, is depressible relative to the first finger-engageable surface. Because the second finger-engageable surface is attached to an element carried by the lighter which has no effect on opening or closing the fuel valve, depression of the second finger-engageable surface cannot actuate the lighter. In the preferred embodiment, both surfaces are biased into a position such that the surfaces form a continuous compound finger pad, i.e., a continuation of one another, when the first finger-engageable surface lies in a valve-closed position. In alternative embodiments, one of the surfaces may be displaced above or below the other surface in the valve-closed position to form a discontinuous compound finger or thumb pad.

With the texture and color of the surfaces being substantially the same, the first finger-engageable surface is not readily identified or discerned by the child as a further lighter-actuating element and, hence, conceals the element of the lighter, i.e., the first finger-engageable surface, which, in fact, will cause actuation. Alternatively, the texture or color of the surfaces may be contrasted to one another. For example, the color of the second surface may be sharper, brighter or different from the color of the first surface. By adopting contrasting indicia, i.e., color and texture, on the first and second surfaces, it is possible to draw a child's attention to concentrate on the second surface and to ignore the first surface.

Because of the reduction in size of the first finger-engageable surface as compared with a full-sized conventional thumb pad, actuation of the lighter is difficult because only the tip or edge of an individual's thumb can engage the first finger-engageable surface. Also, because of the smaller size of the first finger-engageable surface and its location between the second finger-engageable surface and the spark wheel, the magnitude of the force and thumb dexterity required to actuate the lighter is substantially increased. Further, because of a child's smaller thumb size and inability to apply substantial force to the first finger-engageable surface, the lighter is virtually impossible to actuate by a child even assuming the child is aware that lighter actuation requires depression of the first finger-engageable surface.

In a preferred embodiment according to the present invention, there is provided a safety lighter comprising a lighter housing having a reservoir for containing a combustible fuel, a valve for releasing the fuel from the reservoir and movable between valve-open and valve-closed positions, a device for producing a spark for igniting fuel released from the valve when the valve lies in the valve-open position and first and second elements mounted for movement on the lighter housing and having respective first and second finger-engageable surfaces, the first element being coupled to the valve and movable by finger pressure on the first surface to move the valve from the valve-closed position to the valve-open position, the second element being movable by finger pressure on the second surface without moving the valve from the closed position.

In a further preferred embodiment according to the present invention, there is provided a safety lighter comprising a lighter housing having a reservoir for containing a combustible fuel, a valve for releasing the fuel from the reservoir and movable between valve-open and valve-closed positions, a device for producing a spark for igniting fuel released from the valve when in the valve-open position, a first lever pivotally carried by the housing having a first finger-engageable surface adjacent one end thereof and engageable at an opposite end thereof with the valve for moving the valve between the valve-open position and the valve-closed position, an element carried by the housing for movement between first and second positions and having a second finger-engageable surface, the first and second surfaces forming a substantially compound finger-engageable pad when the first lever lies in the valve-closed position and the element lies in the first position, the element being movable independently of the lever from the first position to the second position.

In a still further preferred embodiment according to the present invention, there is provided a safety lighter comprising a lighter housing having a reservoir for containing a combustible fuel, a valve actuatable to release the fuel from the reservoir, an ignition device for igniting fuel released from the valve when actuated, a first element carried by the housing for movement between first and second positions, the first element having a first finger-engageable surface coupled to the valve for actuating the valve in response to movement of the element from the first position to the second position, a second element carried by the housing for movement between first and second positions, the second element having a second finger-engageable surface, the first and second surfaces forming a substantially compound finger-engageable pad when the first and second elements lie in the first positions thereof, the second element being movable independently of the first element from the first position to the second position without actuating the valve.

BEST MODE FOR CARRYING OUT THE INVENTION

Figure 1:
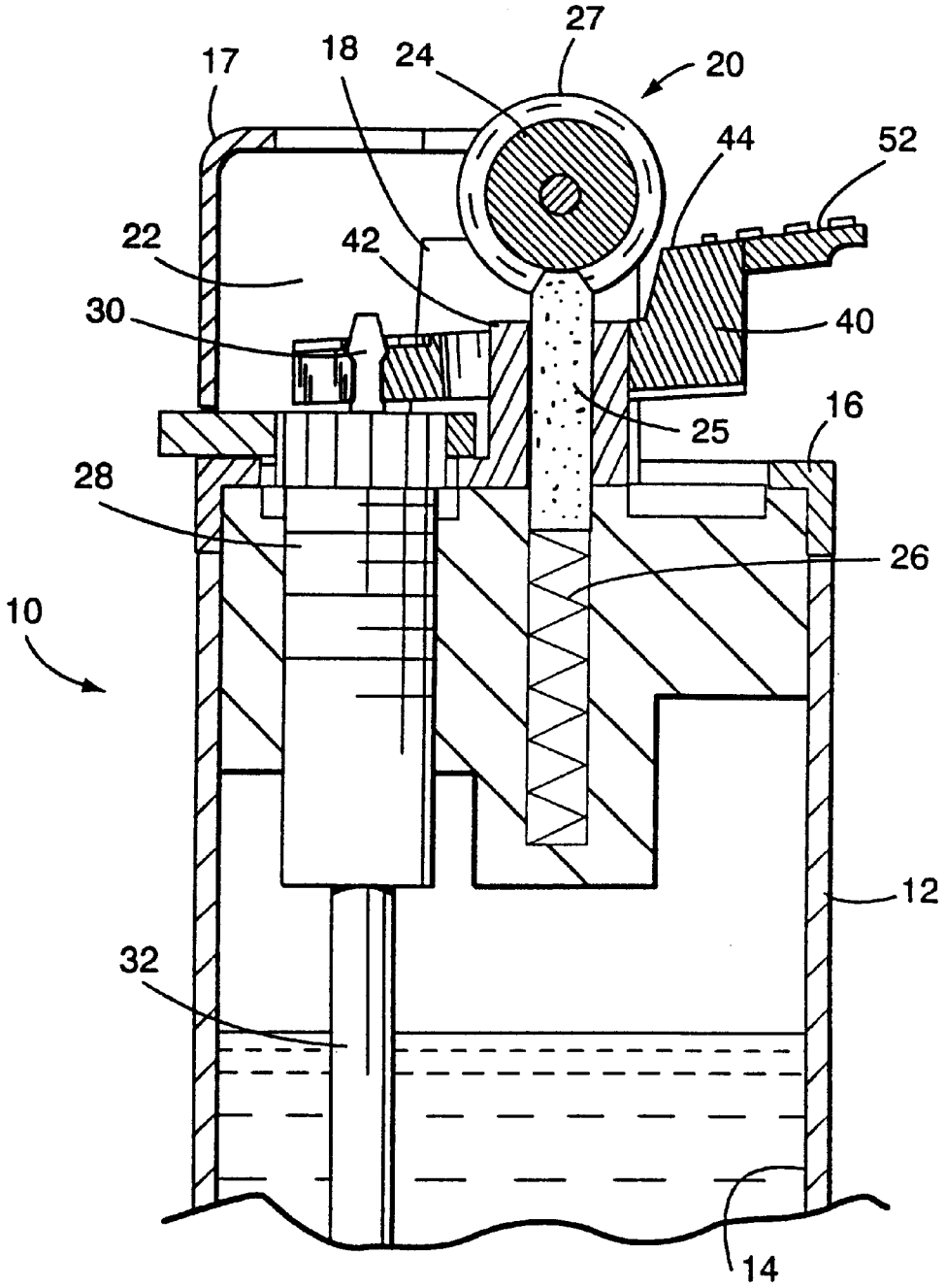
FIG. 1 is a fragmentary cross-sectional view of a child's safety lighter constructed in accordance with a preferred embodiment of the present invention.

Referring now to FIG. 1, there is illustrated a child safety lighter constructed in accordance with a preferred embodiment of the present invention and generally designated 10. Lighter 10 includes a housing 12 having a reservoir 14 for containing fuel and an upper frame 16 secured to the top of housing 12 and a windshield 17 mounted on the frame. Upper frame 16 includes a pair of upstanding arms 18 essentially located along the top of the lighter and between which is mounted an ignition mechanism, generally designated 20. The ignition mechanism 20 includes a device for generating a spark in a combustion ignition region 22. While many different types of spark-generation devices can be employed, preferably there is mounted between the arms 18 a spark wheel 24 which engages a flint 25 biased by spring 26 into engagement along the underside of the spark wheel 24. It will be appreciated that the spark wheel may comprise a conventional spark wheel having a roughened peripheral surface and flanked by a pair of drive wheels 27 fixed to the axle mounting the spark wheel whereby rotation of the spark wheel against flint 25 generates a spark which is directed into the ignition region 22.

A valve 28 is provided for supplying fuel to the ignition region 22. The valve 28 includes a valve actuator stem 30 which, in a preferred form, is spring-biased into a valve-closed position by a spring, not shown, within the valve 28. Fuel is supplied from the fuel reservoir 14 via a tube 32 to the valve 28 such that when the valve stem 30 is raised against the bias of the spring, fuel is supplied to the ignition region 22. The foregoing-described ignition mechanism is conventional in nature and it will be appreciated that conventional spark-generating devices and valves can be used.

In accordance with a preferred embodiment of the present invention, an actuator is provided for actuating the lighter and more particularly for moving the valve 28 between valve-closed and valve-open positions. The actuator includes a first element 40 having an end thereof terminating in a first finger-engageable surface 44. Central portions 41 of element 40 straddle the flint 25 and upstanding flint housing 42 (FIG. 1). The central portions 41 engage or bear against the legs of the second element 50. The opposite end of element 40 from surface 44 terminates in a catch 46 engageable with the valve stem 30 such that, upon pivoting element 40 by engaging a finger, e.g., a thumb, along the finger-engageable surface 44 and depressing, e.g., pivoting, the element 40, the valve stem 30 may be raised, releasing fuel into the ignition region. In this preferred embodiment, upon removal of finger pressure on the first finger-engageable surface 44, the valve spring displaces the valve stem 30 into the valve-closed position, returning the pivoted valve element 40 to its initial position.

The actuator also includes a second element 50 having at one end a second finger-engageable surface 52. The element 50 has a pair of legs 53 straddling the flint housing 42 and the central portions 41 of element 40. The legs terminate adjacent opposite ends thereof in a pair of laterally projecting cylindrical pins 54 which engage in the circular openings 43 in the arms 18 whereby the elements 40 and 50 are pivotally carried by the arms 18. The central portions 41 of element 40 are wedged between the legs 53 of element 50 and bear on flats 55 on element 50. Element 40 is retained in the lighter by the engagement of catch 46 and valve stem 30. Elements 40 and 50 are also pivotally mounted relative to one another. Element 50 also includes a spring which, in a preferred form, comprises a pair of leaf springs 56 having distal ends engageable against the upper frame 16, biasing the first and second elements 40 and 50, respectively, into a position where the finger-engageable surface 52 corresponds to the position of the conventional thumb press of a typical lighter in its non-actuated position. Preferably, the springs 56 bias the element 50 such that its surface 52 and finger-engageable surface 44 of element 40, respectively, form a substantially continuous finger, e.g., thumb pad surface simulating a conventional thumb press of a typical lighter in a non-actuated position. The contiguous edges of the first and second finger-engageable surfaces 44 and 52, respectively, may be shaped to engage one another when the surfaces lie in a continuous, for example, co-planar relation, forming essentially a single continuous compound thumb pad, thereby enabling the biased second element, when moved independently of the first element 40, to return under the bias of spring 56 to a position where the second surface 52 forms a continuation of the first surface 44. In alternate forms hereof, the surface 44 may be higher or lower relative to surface 52 in the non-actuated position of the lighter forming a discontinuous compound finger or thumb pad.

Figure 2:
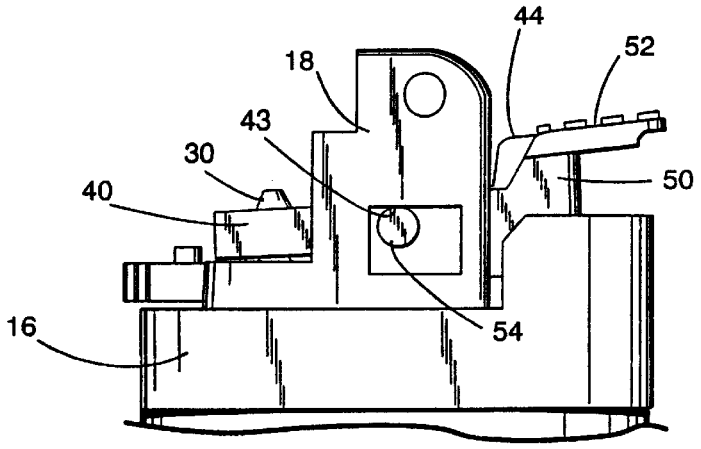
FIGS. 2–4 are fragmentary side elevational views of the lighter illustrating the compound finger pad in various positions and with the windshield removed for clarity.
Figure 3:
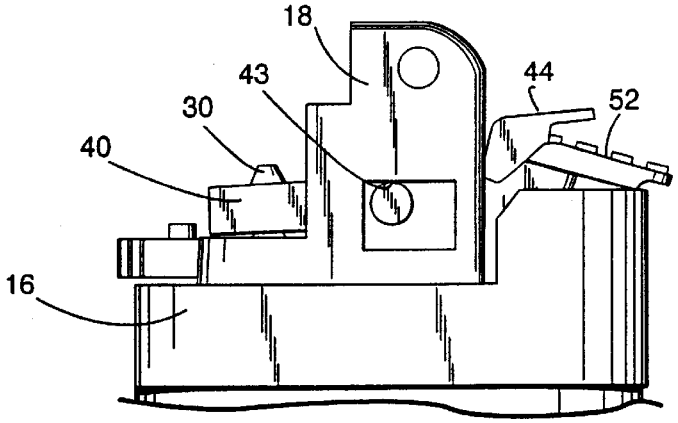
Figure 4:
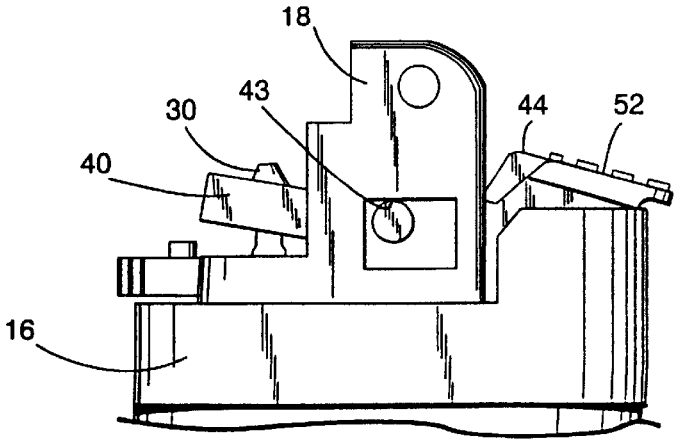
Figure 5:
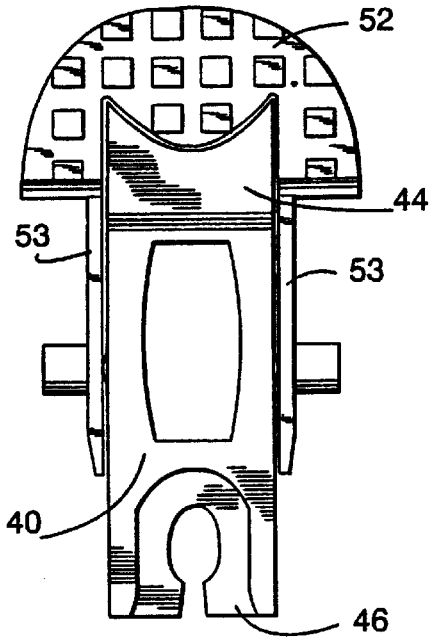
FIG. 5 is a top plan view of the two elements forming the compound finger pad.
Figure 6:
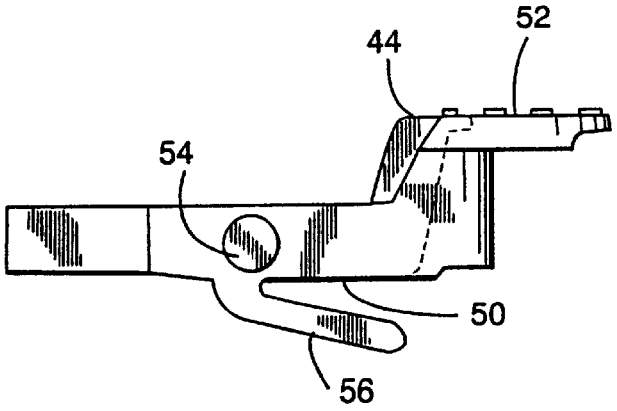
FIG. 6 is a side elevational view thereof in a non-actuated position.
Figure 7:
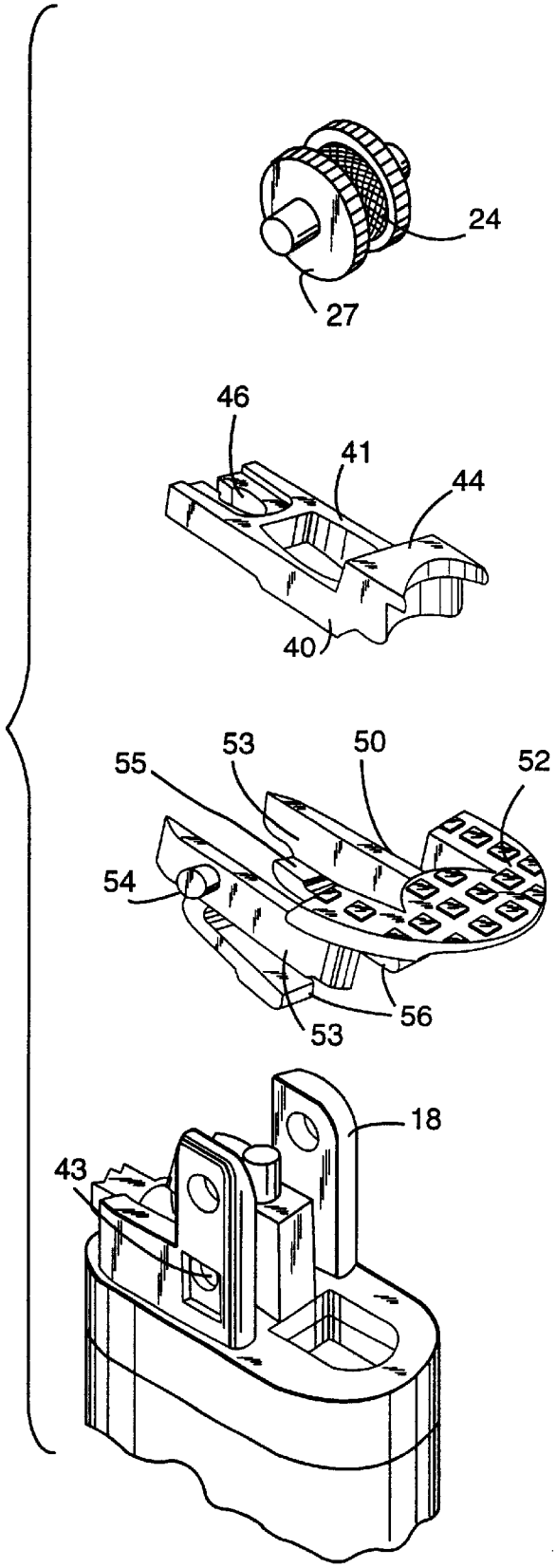
FIG. 7 is an exploded perspective view of the various parts forming the lighter.

It will be appreciated that with the foregoing surfaces 44 and 52 aligned with one another forming a continuous thumb pad, or with slight elevational displacement relative to one another, the appearance of the surfaces of the elements 40 and 50 corresponds substantially to the appearance of a typical valve-actuating thumb pad of a conventional lighter. See, for example, FIGS. 2 and 5. However, it will be appreciated that application of finger pressure on second finger-engageable surface 52 will cause the surface 52 to be depressed against the bias of springs 56 without depressing the surface 44 or pivoting lever 40 See FIG. 3. Thus, the surface 52 serves as a mock lever which can be depressed without effect, e.g., without assisting lighter actuation by moving the valve from a valve-closed to a valve-open position. From the foregoing, it will be appreciated that it is necessary to depress the finger-engageable surface 44 to pivot lever 40 in order to actuate the lighter, i.e., by opening the valve. Thus, while surface 52 is movable independently relative to surface 44 without lighter-actuation effect, lighter actuation will be typically accomplished by depressing both surfaces 44 and 52 together with substantially simultaneous generation of a spark by rotating the spark wheel. From a review of FIG. 1, however, it will also be appreciated that because the surface 44 is located between the surface 52 and the spark wheel 24, a reduced area is provided in which an individual's thumb can depress surface 44. Moreover, because of the reduction in size of surface 44 as compared with the size of a conventional thumb pad which would correspond to the size of the combined surfaces 44 and 52, depression of surface 44 is difficult because only the tip or edge of an individual's thumb can bear on the surface 44. Consequently, a child's smaller thumb typically cannot be applied to the surface 44 with sufficient force to pivot element 40. The child may only be able to pivot the element 50 by depressing finger-engageable surface 52, e.g., as seen in FIG. 3, which has no effect on lighter actuation.

Moreover, because in the preferred embodiment the outer periphery of the surfaces 44 and 52 corresponds to a typical thumb pad, the existence of the discrete surface 44 is not readily noticeable, especially by a child. The child's efforts to depress the thumb pad will result substantially in depressing only the second surface 52 relative to the first surface 44 as illustrated in FIG. 3 without effecting lighter ignition. While the surfaces 44 and 52 are illustrated as having different surface configurations, it will be appreciated that by providing similar or identical surface configurations on both surfaces and providing them in the same color, the existence of the compound surfaces is essentially not noticeable which further inhibits actuation of the lighter by a child. Alternatively, contrasting colors, textures or other contrasting indicia may be employed on surfaces 44 and 52 to draw a child's attention away from surface 44 and toward surface 52.

Figure 8:
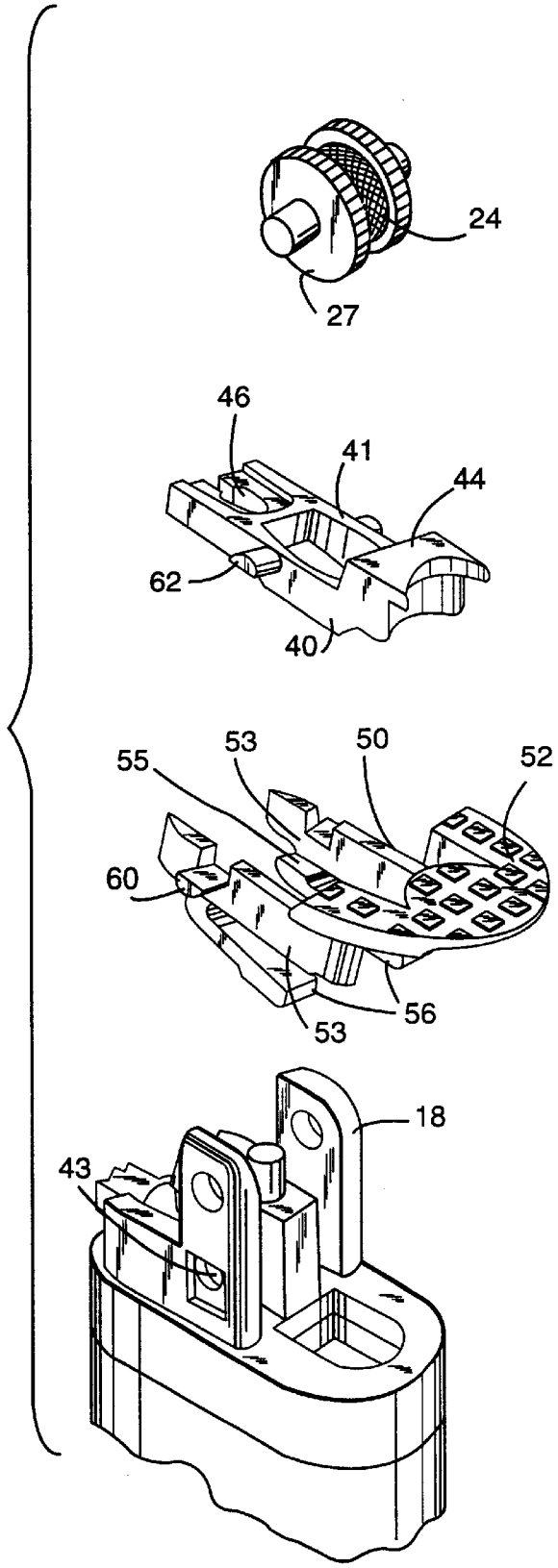
FIG. 8 is a view similar to FIG. 7 illustrating a further embodiment of the invention.

Referring now to FIG. 8, illustrating a further embodiment of the safety lighter hereof, like reference numerals are applied to like parts as in the prior embodiment. In this form, however, the second element 50 includes a pair of laterally extending pins 60 which are semi-cylindrical in configuration. The flat upper surface of the semi-cylindrical pins 60 extend in upwardly opening recesses in the legs 53 of the second element 50. The first element 40 of the actuator also has a pair of semi-cylindrical laterally extending pins 62 projecting from the central portions 41 thereof. The semi-cylindrical pins 60 and 62 in final assembly of the actuator have the flat sides thereof engaged with one another forming bifurcated cylindrical pins received in the openings 43 of arms 18. That is, the semi-cylindrical pins 60 and 62 share the cylindrical openings 43 in the support arms 18 but have sufficient play relative to one another to enable independent pivotal movement. The operation of this embodiment of the safety lighter hereof is identical to the operation of the lighter as described in connection with the first embodiment hereof.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A safety lighter comprising:

a lighter housing having a reservoir for containing a combustible fuel;

a valve for releasing the fuel from the reservoir and movable between valve-open and valve-closed positions;

a device for producing a spark for igniting fuel released from said valve when said valve lies in said valve-open position; and first and second elements mounted for movement on said lighter housing and having respective first and second finger-engageable surfaces, said first element being coupled to said valve and movable from a first position by finger pressure on said first surface into a second position thereby to move said valve from said valve-closed position to said valve-open position, said second element being movable by finger pressure on said second surface from a first position into a second position without inhibiting movement of said first element into said second position to move said valve into said open position.

2. A lighter according to claim 1 wherein said surfaces are disposed on a side of the spark-producing device remote from said valve, said first surface being disposed between said second surface and said spark-producing device.

3. A lighter according to claim 1 wherein said surfaces are substantially continuous relative to one another and form a continuous compound finger-engageable pad.

4. A lighter according to claim 1 wherein said finger-engageable surfaces provide an appearance of a single finger-engageable pad.

5. A lighter according to claim 1 wherein said second surface in said first position thereof forms a substantially continuous compound finger-engageable pad with said first surface of said first element, and a spring for biasing said second element for movement from said second position thereof to said first position.

6. A lighter according to claim 1 wherein said device includes a spark wheel and flint carried by said housing on one side of said valve, said surfaces lying on a side of said spark wheel remote from said valve, said first surface being located substantially between said second surface and said spark wheel.

7. A lighter according to claim 6 wherein the first surface is bounded by said second surface except between said first surface and said spark wheel.

8. A safety lighter comprising:

a lighter housing having a reservoir for containing a combustible fuel;

a valve for releasing the fuel from the reservoir and movable between valve-open and valve-closed positions;

a device for producing a spark for igniting fuel released from said valve when in said valve-open position;

a lever pivotally carried by said housing having a first finger-engageable surface adjacent one end thereof and engageable at an opposite end thereof with said valve for moving said valve between said valve-open position and said valve-closed position; and an element carried by said housing for movement between first and second positions and having a second finger-engageable surface, said first and second surfaces forming a substantially compound finger-engageable pad when said first lever lies in said valve-closed position and said element lies in said first position, said element being movable independently of said lever from said first position to said second position and without inhibiting movement of said lever into said valve-open position.

9. A lighter according to claim 8 wherein said first and second surfaces form with one another a substantially continuous compound finger-engageable pad when said first lever is in said valve-closed position and said element lies in said first position, said element being movable independently of said lever to misalign said first and second surfaces.

10. A lighter according to claim 8 including a spring for biasing said element for movement into said first position thereof.

11. A lighter according to claim 10 wherein said spring comprises a leaf spring integrally formed with said element and disposed between said housing and said surface of said element.

12. A lighter according to claim 8 wherein said device includes a spark wheel and a flint carried by said housing on one side of said valve, said finger-engageable pad lying on a side of said spark wheel remote from said valve, said first finger-engageable surface being located substantially between said second finger-engageable surface and said spark wheel.

13. A safety lighter comprising:

a lighter housing having a reservoir for containing a combustible fuel;

a valve for releasing the fuel from the reservoir and movable between valve-open and valve-closed positions;

a device for producing a spark for igniting fuel released from said valve when said valve lies in said valve-open position;

first and second elements mounted for movement on said lighter housing and having respective first and second finger-engageable surfaces, said first element being coupled to said valve and movable by finger pressure on said first surface to move said valve from said valve-closed position to said valve-open position, said second element being movable by finger pressure on said second surface without moving said valve from said closed position;

said first element being pivotally carried by said housing for movement between positions opening and closing said valve, said first and second elements being pivotal relative to and independently of one another.

14. A lighter according to claim 1 wherein said surfaces are disposed on a side of the spark-producing device remote from said valve.

15. A lighter according to claim 1 wherein said first surface is disposed between said second surface and said spark-producing device.

16. A lighter according to claim 1 wherein said surfaces form a compound finger-engageable pad.

17. A lighter according to claim 1 wherein said surfaces are substantially continuous relative to one another and form a continuous compound finger-engageable pad.

18. A lighter according to claim 1 wherein said finger-engageable surfaces provide an appearance of a single finger-engageable pad.

19. A lighter according to claim 1 wherein said second surface is carried by said housing for movement between first and second positions and in said first position thereof forms a substantially continuous compound finger-engageable pad with said first surface of said first element, and a spring for biasing said second element for movement from said second position thereof to said first position.

20. A lighter according to claim 1 including a spring biasing said second element for movement such that said second surface forms a continuation of the first surface to define therewith a compound finger pad when said first element lies in said position closing said valve.

21. A lighter according to claim 1 wherein said device includes a spark wheel and flint carried by said housing on one side of said valve, said surfaces lying on a side of said spark wheel remote from said valve, said first surface being located substantially between said second surface and said spark wheel.

22. A lighter according to claim 21 wherein the first surface is bounded by said second surface except between said first surface and said spark wheel.

23. A safety lighter comprising:

a lighter housing having a reservoir for containing a combustible fuel;

a valve for releasing the fuel from the reservoir and movable between valve-open and valve-closed positions;

a device for producing a spark for igniting fuel released from said valve when in said valve-open position;

a lever pivotally carried by said housing having a first finger-engageable surface adjacent one end thereof and engageable at an opposite end thereof with said valve for moving said valve between said valve-open position and said valve-closed position;

an element carried by said housing for movement between first and second positions and having a second finger-engageable surface, said first and second surfaces forming a substantially compound finger-engageable pad when said first lever lies in said valve-closed position and said element lies in said first position, said element being movable independently of said lever from said first position to said second positions;

said housing including a pair of support arms, said element being carried by said support arms for pivotal movement relative to said housing, said lever being carried for pivotal movement by said element.

24. A lighter according to claim 23 wherein said first and second surfaces form with one another a substantially continuous compound finger-engageable pad when said lever is in said valve-closed position and said element lies in said first position, said element being movable independently of said first surface to misalign said first and second surfaces.

25. A lighter according to claim 23 including a spring for biasing said element for movement into said first position thereof.

26. A lighter according to claim 25 wherein said spring comprises a leaf spring integrally formed with said element and disposed between said housing and said surface of said element.

27. A lighter according to claim 23 wherein said device includes a spark wheel and a flint carried by said housing on one side of said valve, said finger-engageable pad lying on a side of said spark wheel remote from said valve, said first finger-engageable surface being located substantially between said second finger-engageable surface and said spark wheel.

28. A safety lighter comprising:

a lighter housing having a reservoir for containing a combustible fuel;

a valve actuatable to release the fuel from the reservoir;

an ignition device for igniting fuel released from said valve when actuated;

a first element carried by said housing for movement between first and second positions, said first element having a first finger-engageable surface coupled to said valve for actuating said valve in response to movement of said element from said first position to said second position;

a second element carried by said housing for movement between first and second positions, said second element having a second finger-engageable surface, said first and second surfaces forming a substantially compound finger-engageable pad when said first and second elements lie in said first positions thereof, said second element being movable independently of said first element from said first position to said second position without actuating said valve;

said housing including a pair of support arms, said element being carried by and between said support arms for pivotal movement thereof relative to said housing, said first element being pivotally carried by said second element.

29. A lighter according to claim 28 wherein said second element is movable from said first position into said second position independently of said first element, said first and second surfaces being offset from one another when said first element lies in said first position and said second surface lies in said second position.

30. A lighter according to claim 28 including a spring for biasing said second element for movement into said first position thereof.

31. A lighter according to claim 30 wherein said spring comprises a leaf spring integrally formed with said second element and disposed between said housing and said second surface of said second element.

32. A lighter according to claim 28 including a spark wheel and a flint carried by said housing on one side of said valve, said compound finger-engageable pad lying on a side of said spark wheel remote from said valve, said first finger-engageable surface being located substantially between said second finger-engageable surface and said spark wheel.

33. A lighter according to claim 28 wherein said first surface and said second surface form continuations of one another when said first element and said second element lie in said first positions thereof, the area of said first finger-engageable surface being less than the area of said second finger-engageable surface.

* * * * *